US012564774B2

(12) United States Patent
Metzger

(10) Patent No.: US 12,564,774 B2
(45) Date of Patent: Mar. 3, 2026

(54) GOLF TRAINING SYSTEM AND METHODS

(71) Applicant: GLO PRO, LLC, St. Paul, MN (US)

(72) Inventor: Joseph M. Metzger, St. Paul, MN (US)

(73) Assignee: GLO PRO, LLC, St. Paul, MN (US)

( * ) Notice: Subject to any disclaimer, the term of this patent is extended or adjusted under 35 U.S.C. 154(b) by 309 days.

(21) Appl. No.: 18/029,615

(22) PCT Filed: Sep. 29, 2021

(86) PCT No.: PCT/US2021/052541
§ 371 (c)(1),
(2) Date: Mar. 30, 2023

(87) PCT Pub. No.: WO2022/072416
PCT Pub. Date: Apr. 7, 2022

(65) Prior Publication Data

US 2023/0356056 A1 Nov. 9, 2023

Related U.S. Application Data

(60) Provisional application No. 63/224,781, filed on Jul. 22, 2021, provisional application No. 63/086,084, filed on Oct. 1, 2020.

(51) Int. Cl.
*A63B 69/36* (2006.01)
*A63B 37/00* (2006.01)

(52) U.S. Cl.
CPC .... *A63B 69/3614* (2013.01); *A63B 37/00221* (2020.08); *A63B 69/3661* (2013.01);
(Continued)

(58) Field of Classification Search
CPC ..... A63B 69/3614; A63B 37/00221; A63B 69/3661; A63B 2214/00; A63B 2225/74;
(Continued)

(56) References Cited

U.S. PATENT DOCUMENTS 5,207,429 A * 5/1993 Walmsley ..... A63B 69/3614 473/220
5,228,697 A * 7/1993 Gulick ..... A63B 43/06 473/200

(Continued)

FOREIGN PATENT DOCUMENTS

CN 115557780 A * 1/2023

OTHER PUBLICATIONS

International Search Report and Written Opinion from PCT App. No. PCT/US2021/052541, dated Jan. 11, 2022, 9 pages.

*Primary Examiner* — Nini F Legesse
(74) *Attorney, Agent, or Firm* — Mueting Raasch Group

(57) ABSTRACT

A golf training system generally includes a photoluminescent light-reactive surface and a light source that is placed on a golf club. During a training stroke performed over the photoluminescent surface, the light source excites phosphors in the light-reactive surface during a stroke and in doing so creates a transient visible "record" of the precise track the club head makes during the stroke. In some embodiments, the system can include a training ball having a phosphorescent material affixed to or integrated into the surface of the ball so that a light source placed on the golf club excites the phosphorescent material and indicates the point of contact between the golf club and the training ball.

15 Claims, 3 Drawing Sheets

(52) U.S. Cl.
CPC ..... *A63B 2214/00* (2020.08); *A63B 2225/74* (2020.08); *A63B 2225/76* (2020.08)

(58) Field of Classification Search
CPC ..... A63B 2225/76; A63B 2071/0647; A63B 71/0622; A63B 2071/0694; A63B 43/06
USPC ..... 473/131, 220, 221, 351, 409
See application file for complete search history.

(56) References Cited

U.S. PATENT DOCUMENTS 5,330,195 A * 7/1994 Gulick ..... A63B 43/06 473/200
5,472,204 A * 12/1995 English ..... A63B 69/3676 362/427
5,788,588 A * 8/1998 Hooker ..... A63B 69/3685 473/409
5,848,944 A * 12/1998 Brannen ..... A63B 69/3614 473/409
5,989,135 A * 11/1999 Welch ..... A63B 37/0075 273/DIG. 24
6,796,910 B1 * 9/2004 Foster ..... A63B 69/3614 473/220
7,077,765 B2 7/2006 Grossmeyer et al.
8,894,501 B1 * 11/2014 Stillwagon ..... A63B 53/04 473/220
8,961,328 B1 * 2/2015 Schmok ..... G09B 19/0038 473/409
8,998,739 B2 4/2015 Haight et al.
10,881,939 B2 * 1/2021 Youk ..... F21V 33/008
10,940,381 B1 3/2021 Huether
2005/0009617 A1 * 1/2005 Grossmeyer ..... A63B 69/3614 473/223
2008/0108454 A1 * 5/2008 Kohnen ..... A63B 37/0003 362/253
2008/0200277 A1 8/2008 Mitchell
2014/0141901 A1 5/2014 Haight et al.
2015/0051008 A1 * 2/2015 Schmok ..... G09B 19/0038 473/220
2016/0287966 A1 10/2016 Fritz et al.
2019/0184242 A1 * 6/2019 Molinari ..... A63B 41/02

* cited by examiner

GOLF TRAINING SYSTEM AND METHODS

CROSS-REFERENCE TO RELATED APPLICATIONS

This application is the § 371 U.S. National Stage of International Application No. PCT/US2021/052541, filed Sep. 29, 2021, which claims priority to U.S. Provisional Patent Application No. 63/086,084, filed Oct. 1, 2020, and U.S. Provisional Patent Application No. 63/224,781, filed Jul. 22, 2021, each of which is incorporated herein by reference in its entirety.

SUMMARY

This disclosure describes, in one aspect, a golf training system. Generally, the golf training system includes a light source (14) attached to golf club (10) and a phosphorescent substrate (20) positioned beneath the light source (14) and golf club (10). The phosphorescent substrate (14) is selected to produce a phosphorescent signal (22) when exposed to light from the light source (14) so that the phosphorescent signal has a duration of from one second to 30 seconds.

In some embodiments, the light source (14) emits light having a wavelength of from 200 nm to 410 nm.

In some embodiments, the light source is attached to the golf club on or near the club head.

In some embodiments, the phosphorescent substrate includes $Eu^{2+}$,$Dy^{3+}$,B:$SrAl_2O_{x\ green}$.

In another aspect, this disclosure describes a method of recording a golf swing path. Generally, the method includes providing any embodiment of the golf training system summarized above, and performing a training stroke over the phosphorescent substrate (20) so that light (16) emitted from the light source (14) excites the phosphorescent substrate (20), thereby producing a phosphorescent signal (22) that records the swing path.

In some embodiments, the phosphorescent signal (22) is transient. In some of these embodiments, the phosphorescent signal (22) has a duration of from one second to 60 seconds.

In another aspect, this disclosure describes a ball for use in conjunction with the golf training system. Generally, the training ball (24), includes a surface (25), wherein at least a portion of the surface include a phosphorescent material. The phosphorescent material is selected to produce a phosphorescent signal when exposed to light from the light source, the phosphorescent signal having a duration of from one second to 30 seconds.

In some embodiments, the phosphorescent material of the training ball includes $Eu^{2+}$,$Dy^{3+}$,B:$SrAl_2O_{x\ green}$, or any combination thereof.

In some embodiments, the phosphorescent substrate coating at least a portion of the training ball includes $SrAl_2O_4$.

In another aspect, this disclosure describes a method for recording a point of contact between a golf club and a training ball. Generally, the method includes providing any embodiment of the golf training system and training ball summarized above, performing a training stroke such that club head (13) contacts at least a portion of the surface of the training ball such that the light emitted from the light source (14) attached to the golf club (10) excites the phosphorescent substrate of the training ball producing a phosphorescent signal (23) at the point of contact between the club head (13) and the surface (25) of the training ball.

In some embodiments, the phosphorescent signal (23) is transient.

In some embodiments, the phosphorescent signal (23) has a duration of from one second to 60 seconds.

In some embodiments, the phosphorescent signal (23) is visible with no additional components.

In another aspect, this disclosure describes a method for simultaneously recording a training swing path and a point of contact between a golf club and a training ball. Generally, the method includes providing any embodiment of the golf training system and training ball summarized above, performing a training stroke having a swing path wherein the golf club head contacts at least a portion of the surface of the training ball. Light (16) emitted from the light source (14) excites both a phosphorescent substrate (20) positioned beneath the light source (14), the golf club (10), and the training ball, and a second phosphorescent material applied to, affixed to, or integrated into the surface of the training ball, thereby producing a first phosphorescent signal (22) that records the swing path and a second phosphorescent signal (23) that records the point of contact between the club head and the surface of the training ball.

In some embodiments, the first phosphorescent signal or the second phosphorescent signal is transient.

In some embodiments, the first phosphorescent signal and the second phosphorescent signal are transient.

In some embodiments, the first phosphorescent signal or the second phosphorescent signal has a duration from one to 60 seconds.

In some embodiments, the first phosphorescent signal and the second phosphorescent signal have a duration from one to 60 seconds.

In some embodiments, the first phosphorescent signal and the second phosphorescent signal are visible with no additional components.

The above summary is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

Reference throughout this specification to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout this specification are not necessarily referring to the same embodiment of the disclosure. Furthermore, the particular features, configurations, compositions, or characteristics may be combined in any suitable manner in one or more embodiments. Furthermore, the particular features, configurations, compositions, or characteristics may be combined in any suitable manner in one or more embodiments. Thus, features described in the context of one embodiment may be combined with features described in the context of a different embodiment except where the features are necessarily mutually exclusive.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful and is not intended to exclude other embodiments from the scope of the invention.

DETAILED DESCRIPTION OF ILLUSTRATIVE EMBODIMENTS

Figure 1:
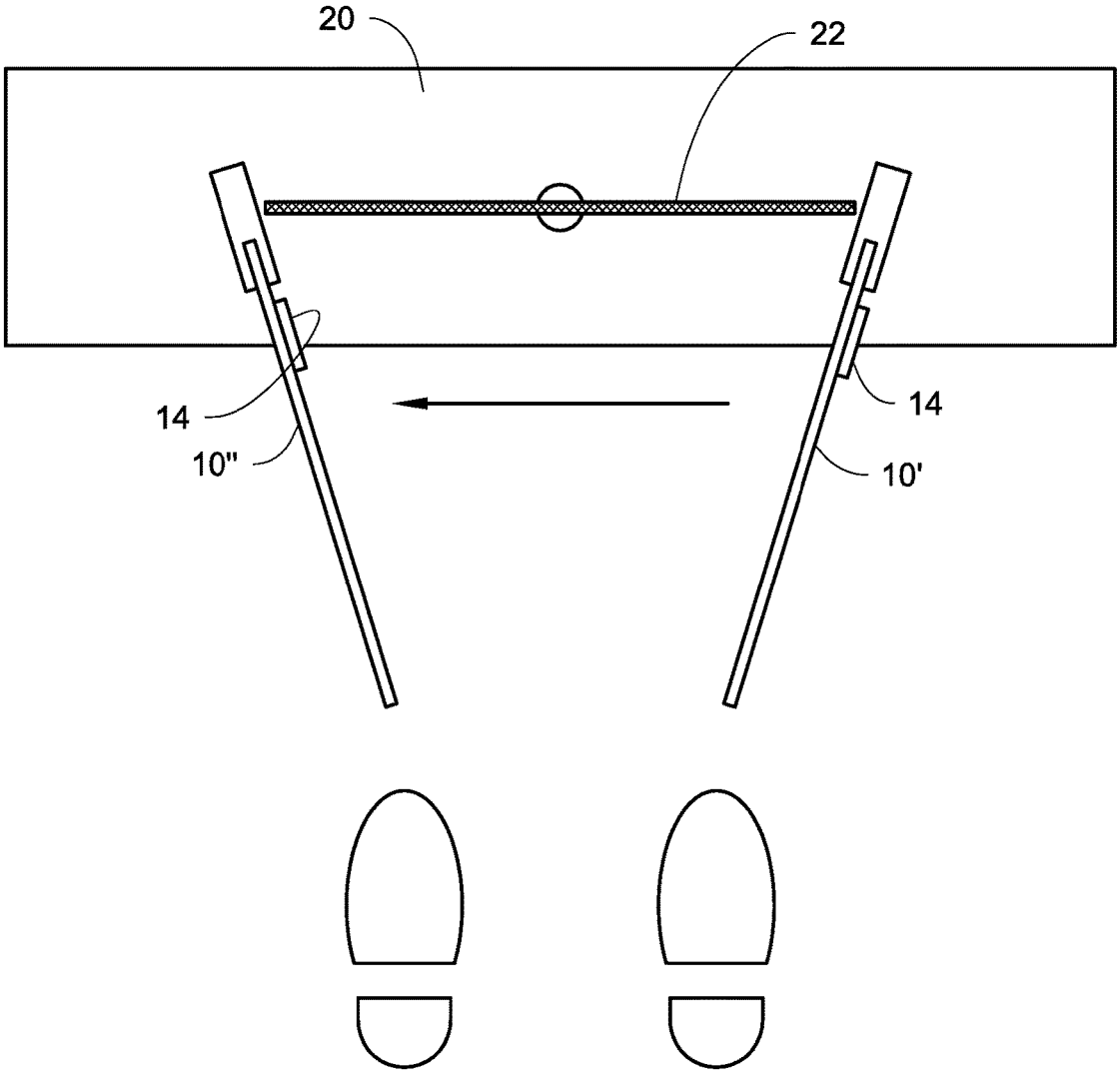
FIG. 1. Schematic illustration of an exemplary light record of swing path. The light record decays in intensity with time so that the device is reusable.

This disclosure describes a golf training system that allows one to receive instant feedback regarding a golf stroke. The feedback is based on a temporary phosphorescent signal that both immediately reflects swing path and decays rapidly enough so that the system is reusable for subsequent strokes. In some embodiments, the golf training system can further include a training ball specifically designed for use with the training system.

Generally, the system includes a photoluminescent light-reactive surface and a single UV/violet light (LED/laser) source that is placed on a golf club. The light source excites phosphors in the light-reactive surface during a stroke and in doing so creates a visible "record" of the precise track the club head makes during the stroke. Under typical ambient lighting conditions (e.g., home, office, or other indoor environment), the signal is bright enough to be seen by the naked eye—i.e., can be visualized without the aid of any additional component (e.g., a detector, monitor, etc.)—and then decays in intensity in a manner of several seconds so that the photoluminescent light-reactive surface is in condition to display a visible record of a subsequent stroke. Thus, the transient nature of the record provides visual feedback to the user, but is non-permanent so that the system is reusable for multiple swings, and can therefore provide a new, clean record for each stroke without interference of the record of any previous stroke. That is, each training stroke can produce a record of the training stroke that is clearly discernible to the naked eye from the record of any previous training stroke.

In some cases, the system can be used in combination with a specially designed training ball having a surface containing phosphors so that a light source can produce a visible record of the point of contact between the club head and the training ball.

Photoluminescent or "glow-in-the-dark" compounds are referred to as phosphorescent crystals or pigments. These substances absorb light and then re-emit light over a variable length of time. This occurs when electrons absorb energy in the presence of specific light wavelengths, and they then move up to a higher orbit. In the absence of light energy, these same electrons fall from a higher energy level to a lower, more stable energy level. When the electrons move to the lower, more stable orbit, they emit energy in the form of visible light.

Phosphorescence is a type of photoluminescence that differs in important aspects from fluorescence and chemiluminescence. A fluorescent material typically re-emits all of the energy it absorbs from a light source essentially instantaneously—in the order of milliseconds so no "record" of excitation can be discerned by the naked eye. In contrast, a phosphorescent material typically does not immediately re-emit all of the energy that it absorbs from a light source. Rather, the phosphorescent material re-emits energy over the course of several seconds to hours, thereby creating a visible record of excitation that is discernible to the naked eye.

Chemiluminescence involve a chemical reaction that creates an excited state. The excited electron is then transferred to a fluorophore that fluoresces as the excited electron returns to the ground state. The signal is therefore dependent upon a chemical reaction. Thus, maintaining a chemiluminescent signal requires replenishment of reactants that create the excited electron. In contrast, phosphorescence requires no added chemicals for the reaction. Accordingly, the phosphorescent signal can be regenerated over and over again without consuming components essential to generate the signal.

The system described herein is simple to set up and use, is easily portable, and requires no moving parts. FIG. 1 shows a schematic top view of the system. The system includes a phosphorescent substrate (20) over which the golf stroke is performed. The phosphorescent substrate includes a phosphorescent material that, after having been exposed to light of an appropriate wavelength, emits a phosphorescent signal (22). In the illustrative embodiment shown in FIG. 1, a light source (14) attached to a golf club (10) provides the light that excites the phosphorescent material and generates a phosphorescent signal (22) that transiently records the path of the golf club (10) from a first position (10') to a second position (10")—i.e., a "training stroke."

The phosphorescent signal (22) decays—or dims—over the course of seconds so that the phosphorescent substrate (20) is in condition to display a visible record of a subsequent training stroke. In some embodiments, the phosphorescent signal (22) may dim rapidly enough that the phosphorescent substrate (20) is essentially "clean" for a subsequent training stroke. In other embodiments, remnants of the phosphorescent signal (22) of a first training stroke may dim sufficiently so that the phosphorescent signal (22) of a subsequent, second training stroke is readily discernible from the phosphorescent signal (22) of the first training stroke. Thus, it is not necessary for the phosphorescent substrate (20) to be completely "clean" in order to perform a training stroke. Rather, the transient nature of the phosphorescent signal (22) can allow one to discern with the naked eye the phosphorescent signals (22) produced by multiple training strokes even when made in rapid succession.

The system may be used with or without striking a golf ball. In the context of an embodiment in which the system is used without striking a golf ball, the phosphorescent substrate (20) may be attached, affixed, or otherwise integrated with any suitable substrate that allows an uninterrupted golf stroke to be performed over the phosphorescent substrate (20). For example, in some embodiments, the phosphorescent substrate (20) may therefore be painted or taped onto a substrate. In other embodiments, the phosphorescent substrate (20) can include a powder incorporated into a substrate or a fabric attached or affixed to a substrate.

A suitable substrate is typically thin enough to allow that the substrate does not interfere with a normal golf stroke. For example, the substrate may be no more than 10 cm such as, for example, no more than 5 cm, no more than 4 cm, no more than 3 cm, no more than 2 cm, no more than 1 cm, no more than 900 mm, no more than 800 mm, no more than 700 mm, no more than 600 mm, no more than 500 mm, no more than 400 mm, no more than 300 mm, no more than 200 mm, no more than 100 mm, no more than 90 mm, no more than 80 mm, no more than 70 mm, no more than 60 mm, no more than 50 mm, no more than 40 mm, no more than 30 mm, no more than 20 mm, no more than 10 mm, no more than 9 mm, no more than 8 mm, no more than 7 mm, no more than 6 mm, no more than 5 mm, no more than 4 mm, no more than 3 mm, no more than 2 mm, no more than 1 mm, no more than 0.9 mm, no more than 0.8 mm, no more than 0.7 mm, no more than 0.6 mm, no more than 0.5 mm, no more than 0.4 mm, no more than 0.3 mm, no more than 0.2 mm, or no more than 0.1 mm. In some embodiments, the phosphorescent substrate (20) may be "paper thin"—e.g., 0.05 mm to 0.1 mm thick.

In the context of an embodiment in which the system is used with striking a golf ball, the phosphorescent substrate (20) may be applied to, attached to, affixed to, or otherwise integrated into a substrate that allows a struck golf ball to roll or otherwise be propelled by the golf club without interfering with the golf stroke. Thus, the substrate may be any conventional manufactured substrate used as a substrate from which one can hit a golf ball and having a top surface to which one can apply, attach, or affix the phosphorescent substrate (20) or into which the phosphorescent substrate (20) may be integrated. The substrate also can be any generally flat surface on which one can lay the phosphorescent substrate (20). Exemplary substrates include, for example, a mat (e.g., a mat with a rubber or rubberized base) or flooring (e.g., wood, laminate, linoleum, concrete, carpet, etc.), or other generally flat surface.

In some embodiments, the phosphorescent substrate (20) may be, or may be applied to, attached to, affixed to, or integrated into a substrate that is portable. That is, the phosphorescent substrate (20) may be, or may be applied to, attached to, affixed to, or integrated into a substrate that can be folded or rolled for easy transport, then unfolded or unfurled for use—e.g., at a designated practice facility, office, hotel room, or other suitable location.

The light source (14) may be selected in conjunction with the phosphorescent substrate (20) to produce a visible phosphorescent signal when the light source (14) emits light (16) toward the phosphorescent substrate (20). Table 1 evaluates the brightness of a phosphorescent signal produced when various wavelengths of light from a light source are used in conjunction with various exemplary phosphor compounds under ambient indoor lighting conditions.

TABLE 1

Assessment of photoluminescent brightness as a function of phosphor compound and excitation wavelength. Tested under normal ambient lighting conditions

| | Wavelength light | | |
|---|---|---|---|
| Phosphor compound | 200-405 nm (UV-violet) | 500-540 nm (green) | 632 nm (red) |
| ZnSu | + | – | – |
| $Eu^{2+}$,$Dy^{3+}$,B:$SrAl_2O_{x\ green}$ | ++++ | – | – |
| $Eu^{2+}$,$Dy^{3+}$,B:$SrAl_2O_{x\ orange}$ | –/+ | – | – |

TABLE 1-continued

Assessment of photoluminescent brightness as a function of phosphor compound and excitation wavelength. Tested under normal ambient lighting conditions

| | Wavelength light | | |
|---|---|---|---|
| Phosphor compound | 200-405 nm (UV-violet) | 500-540 nm (green) | 632 nm (red) |
| $Eu^{2+}$,$Dy^{3+}$,B:$SrAl_2O_{x\ aqua}$ | – | – | – |
| $Eu^{2+}$,$Dy^{3+}$,B:$SrAl_2O_{x\ red}$ | + | – | – |
| $Eu^{2+}$,$Dy^{3+}$,B:$SrAl_2O_{x\ skyblue}$ | – | – | – |
| $Eu^{2+}$,$Dy^{3+}$,B:$SrAl_2O_{x\ violet}$ | – | – | – |

–: no signal

+: signal detected, brightness quantified

Some phosphorescent substrates fail to produce a visible signal bright enough for use under ambient indoor lighting conditions, even when the light source (14) is placed within inches or even in direct contact with the phosphorescent substrate (20). For example, blue and turquoise phosphorescent substrates produce a signal that is too weak to be readily visible in ambient indoor lighting conditions. Moreover, some green phosphorescence surfaces have poor signal-to-noise ratio (brightness) or duration. Some phosphorescent surfaces may produce a bright signal, but decays too slowly so that the duration of the signal is too persistent to allow the phosphorescent substrate (20) to allow one to discern with the naked eye the phosphorescent signals (22) of subsequent training strokes made in rapid succession (e.g., within five seconds of one another).

The light source (14) and the phosphorescent substrate (20) also may be selected to provide a phosphorescent signal (22) of a desired duration. Table 2 shows the quality and duration of phosphorescent signals of exemplary phosphor compounds

TABLE 2

Photoluminescent duration as a function of phosphor compound and optimal excitation wavelength in ambient lighting.

| Phosphor compound | Visual record duration |
|---|---|
| ZnSu | + |
| $Eu^{2+}$,$Dy^{3+}$,B:$SrAl_2O_{x\ green}$ | ++++ |
| $Eu^{2+}$,$Dy^{3+}$,B:$SrAl_2O_{x\ orange}$ | –/+ |
| $Eu^{2+}$,$Dy^{3+}$,B:$SrAl_2O_{x\ aqua}$ | – |
| $Eu^{2+}$,$Dy^{3+}$,B:$SrAl_2O_{x\ red}$ | + |
| $Eu^{2+}$,$Dy^{3+}$,B:$SrAl_2O_{x\ skyblue}$ | – |
| $Eu^{2+}$,$Dy^{3+}$,B:$SrAl_2O_{x\ violet}$ | – |

In some embodiments, the phosphorescent signal (22) may have a minimum duration of at least one second such as, for example, at least two seconds, at least three seconds, at least four seconds, at least five seconds, at least six seconds, at least seven seconds, at least eight seconds, at least nine seconds, or at least ten seconds. In some embodiments, the phosphorescent signal (22) may have a maximum duration of no more than 60 seconds such as, for example, no more than 30 seconds, no more than 20 seconds, no more than 19 seconds, no more than 18 seconds, no more than 17 seconds, no more than 16 seconds, no more than 15 seconds, no more than 14 seconds, no more than 13 seconds, no more than 12 seconds, no more than 11 seconds, no more than ten seconds, no more than nine seconds, no more than eight seconds, no more than seven seconds, no more than six seconds, or no more than five seconds. In some embodiments, the duration of the phosphorescent signal may be expressed as a range having endpoints defined by any minimum duration listed above and any maximum duration listed above that is greater than the selected minimum duration.

Thus, in some embodiments, the phosphorescent signal may have a duration of from one second to 20 seconds such as, for example, from two seconds to 15 seconds, from three seconds to 15 seconds, from two seconds to ten seconds, from two seconds to five seconds, or from three seconds to ten seconds.

In certain embodiments, the phosphorescent signal may have a duration equal to any minimum duration or any maximum duration listed above. Thus, for example, the phosphorescent signal may have a duration of one second, two seconds, five seconds, ten seconds, 12 seconds, 20 seconds, or 60 seconds.

Thus, in one embodiment, the phosphorescent substrate (20) includes $Eu^{2+}$,$Dy^{3+}$,B:$SrAl_2O_{x\ green}$. In other embodiments, however, the phosphorescent substrate can include $Eu^{2+}$,$Dy^{3+}$,B:$SrAl_2O_{x\ orange}$, $Eu^{2+}$,$Dy^{3+}$,B:$SrAl_2O_{x\ n\ red}$, ZnSu, or other suitable phosphorescent material that provides a phosphorescent signal of suitable brightness and/or suitable duration. For example, $Ba^{2+}$/$Mg^{2+}$ aluminate doped with Eu or Dy may, in certain embodiments, be a suitable phosphorescent material.

The light source (14) can be any suitable source of light that excites the phosphor compound in the phosphorescent substrate (20) to produce the desired color, brightness, and duration of phosphorescent signal (22). For example, an LED light source may be easily attached to a golf club using a fastener (12). An ultraviolet (UV) laser also could be used. In embodiments using an UV laser, precautions against eye damage may be advised due to the energy of the light source. Regardless of the specific light source used, the light (16) emitted is generally sufficiently focused to provide a record of the training golf stroke.

Figure 2:
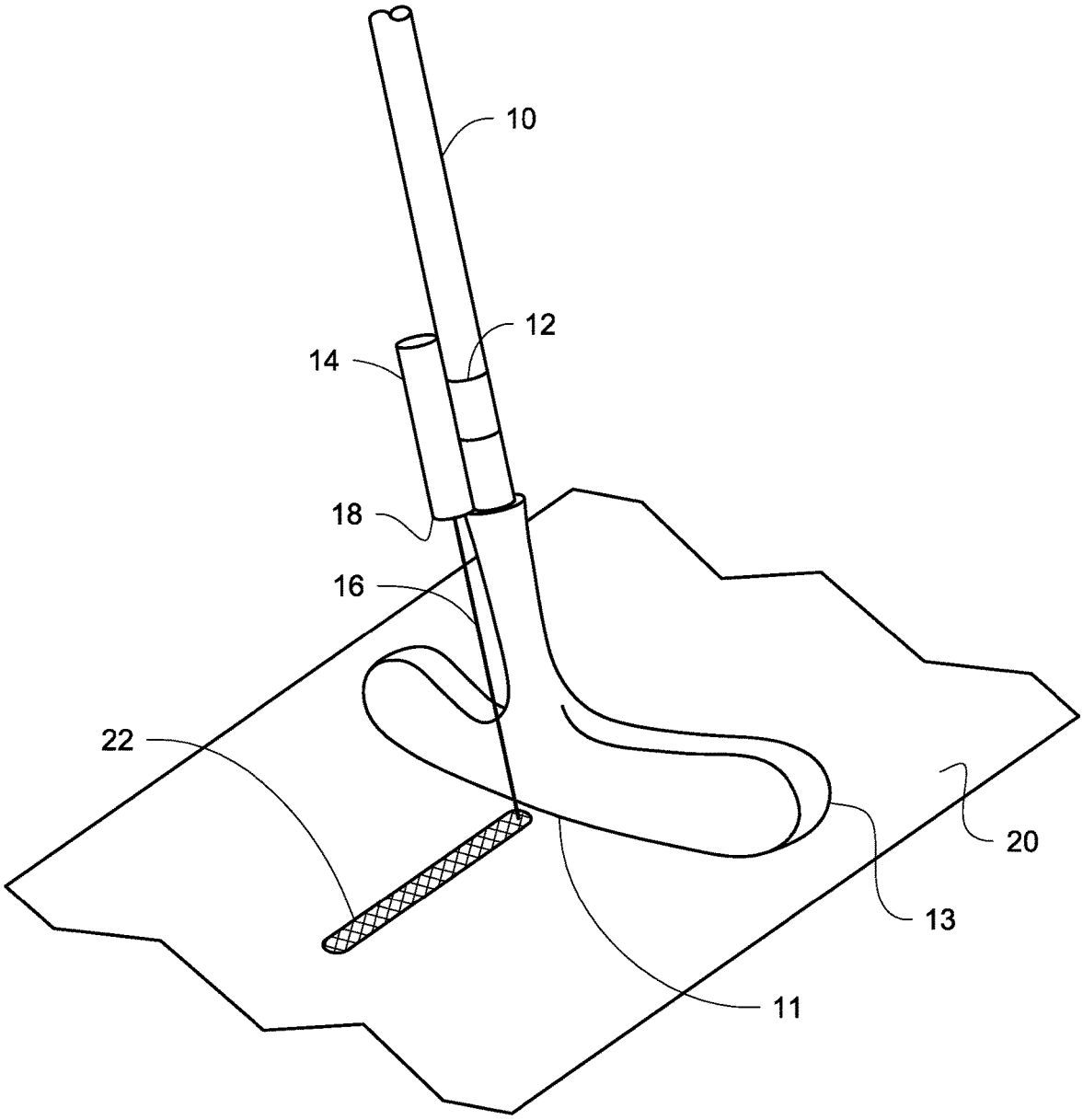
FIG. 2. Perspective view of the system, including a golf club (10) with light source (14) attached to the golf club with a fastener (12). The light source (14) emits light (16), which generates a phosphorescent signal (22) on the surface of the phosphorescent substrate (20).

In the embodiment of the system illustrated in FIG. 2, the light source (14) is easily and reversibly attached to the golf club (10) to be generally parallel to the shaft of the golf club (10) to reflect the path that the golf club (10) travels during the training golf stroke. Generally, the phosphorescent signal (22) produced will provide most useful feedback if the light source (14) is aligned on the golf club (10) so that the light (16) traces the movement of the portion of head of the golf club used to strike a golf ball, regardless of whether the training stroke actually involves striking a golf ball.

The light source (14) is reversibly attached to the golf club (10) using a fastener (12). The fastener (12) may include any suitable mechanism for fastening the light source (14) to the golf club (10) and may be manufactured of any suitable material such as, for example, metal or plastic. Suitable fasters include, but are not limited to, a band, putty, blue tack, caulking cord, a bendable wire or cord, a clamp, a clasp, a clip, a snap fit, an interference fit, an adhesive, etc. In some embodiments, the fastener (12) may be combined with a material to increase friction between the fastener (12) and the golf club (10) to counteract centrifugal force of a partial or full golf swing so that the light source (14) remains in a fixed position on the golf club (10) throughout a training stroke. Suitable friction enhancers can include an adhesive or a putty that is interposed between the fastener (12) and the golf club (10).

The light source (14) may be attached to the golf club (10) at any location on the golf club that allows the light source (14) to generate a phosphorescent signal (22) when the user executes a training stroke above the phosphorescent substrate (20). Thus, a light source (14) that emits a high energy light (16)—e.g., a UV laser—may be positioned further away from the sole (11) of the golf club (10) and still generate a usable phosphorescent signal (22) than a light source (14) that emits lower energy light. In practice, a light source (14) attached to the golf club (10) closer to the sole (11) of the golf club (10) may be considered to provide a more precise visual record of the path of the club head during the training stroke than if the light source (14) is attached to the golf club (10) further away from the sole (11) of the club. Thus, one may choose to attach the light source (14) closer to the sole (11) of the golf club (10) when a more precise record is desired—e.g., when practicing a putting stroke. A light source (14) attached to the golf club (10) further from the sole (11) of the golf club (10) may be less subject to centrifugal force during the practice stroke. Thus, one may choose to attach the light source (14) further from the sole (11) of the golf club (10) when the practice stroke may generate significant centrifugal force—e.g., when practicing a full golf swing.

Thus, in some embodiments, the light source (14) may be attached to the golf club (11) so that the distal end (18) of the light source (14) is a predetermined distance from the point at which the light (16) intersects a plane that is generally defined by the sole (11) of the golf club (10) and is generally parallel to the phosphorescent substrate (20) over which the training stroke is executed.

In some embodiments, the predetermined distance may be a minimum of at least 0.1 cm such as, for example, at least 0.2 cm, at least 0.3 cm, at least 0.4 cm, at least 0.5 cm, at least 0.6 cm, at least 0.7 cm, at least 0.8 cm, at least 0.9 cm, at least 1 cm, at least 2 cm, at least 3 cm, at least 4 cm, at least 5 cm, at least 6 cm, at least 7 cm, at least 8 cm, at least 9 cm, at least 10 cm, at least 20 cm, at least 30 cm, at least 40 cm, at least 50 cm, at least 60 cm, at least 70 cm, at least 80 cm, at least 90 cm, or at least 100 cm. In some embodiments, the predetermined distance may be a maximum of no more than 150 cm such as, for example, no more than 130 cm, no more than 125 cm, no more than 120 cm, no more than 115 cm, no more than 110 cm, no more than 105 cm, no more than 100 cm, no more than 95 cm, no more than 90 cm, no more than 80 cm, no more than 70 cm, no more than 60 cm, no more than 50 cm, no more than 40 cm, no more than 30 cm, no more than 20 cm, no more than 15 cm, no more than 14 cm, no more than 13 cm, no more than 12 cm, no more than 11 cm, no more than 10 cm, no more than 9.5 cm, no more than 9.0 cm, no more than 8.5 cm, no more than 8.0 cm, no more than 7.5 cm, no more than 7.0 cm, no more than 6.5 cm no more than 6.0 cm, no more than 5.5 cm, no more than 5.0 cm, no more than 4.5 cm, no more than 4.0 cm, no more than 3.5 cm, no more than 3.0 cm, no more than 2.5 cm, or no more than 2 cm. In some embodiments, the predetermined distance may be expressed as a range having endpoints defined by any minimum predetermined distance listed above and any maximum predetermined distance listed above that is greater than the selected minimum predetermined distance.

In certain embodiments, the predetermined distance can be equal to any minimum predetermined distance or any maximum predetermined distance listed above. Thus, for example, the predetermined distance can be 0.1 cm, 0.5 cm, 2 cm, 10 cm, 100 cm, 120 cm, Or 150 cm.

Accordingly, the position of the light source (14) may be determined, at least in part, by the nature of light source (14) and, in particular, the excitation energy provided by the light source (14). For example, a 5 mW laser produces light with sufficient excitation energy that it can be placed virtually anywhere on the golf club (10)—e.g., the distal end of the light source (14) may be up to 150 cm from the sole (11) of the golf club (10)—and produce a phosphorescent signal (22) when the golf club (10) is swung over the phosphorescent substrate (20) during a training stroke. A laser producing light with an excitation energy of no more than 4 mW, no more than 3 mW, no more than 2 mW, or no more than 1 mW also may be used. Lasers producing light with an excitation energy of greater than 5 mW can be used, but care should be taken to avoid inadvertent eye damage.

In contrast, an LED light source produces incoherent light with much lower energy than a laser and can generally be used without concern of inadvertent eye damage. An LED light source is generally attached to the golf club (10) so that the light is closer to the surface of the phosphorescent substrate during a training stroke. In some embodiments, the best performance is obtained by attaching the light source (14) on the golf club (10) at the club head (13) so that the light (16) emitted is as close as possible to the photoreactive surface of the phosphorescent substrate (20) without impeding the normal glide path of the club head (13) through the contact zone.

While described above in the context of an exemplary embodiment in which the light source (14) is attached to a golf club (10), the system described herein may be used in the context of any facsimile of a golf club—e.g., any suitable generally straight shaft that one can use to simulate a golf swing or putting stroke. Exemplary facsimiles of a golf club include, for example, a golf shaft without a club head, a broom handle, a rake handle, pole, telescoping pointer, etc.

While such alternatives to using a golf club are possible, one feature of the system described herein is that one can use the system with one's own golf club. The light source (14) is easily and reversibly attachable to a golf club without permanently altering the golf club. Also, because the system is designed to be used with one's own golf club, one can strike the ball as one normally would with the golf club, thereby producing visual feedback of the swing path of an actual golf stroke. Moreover, the system described herein provides precise, transient visual feedback of the entire club head path through the contact zone.

Figure 3:
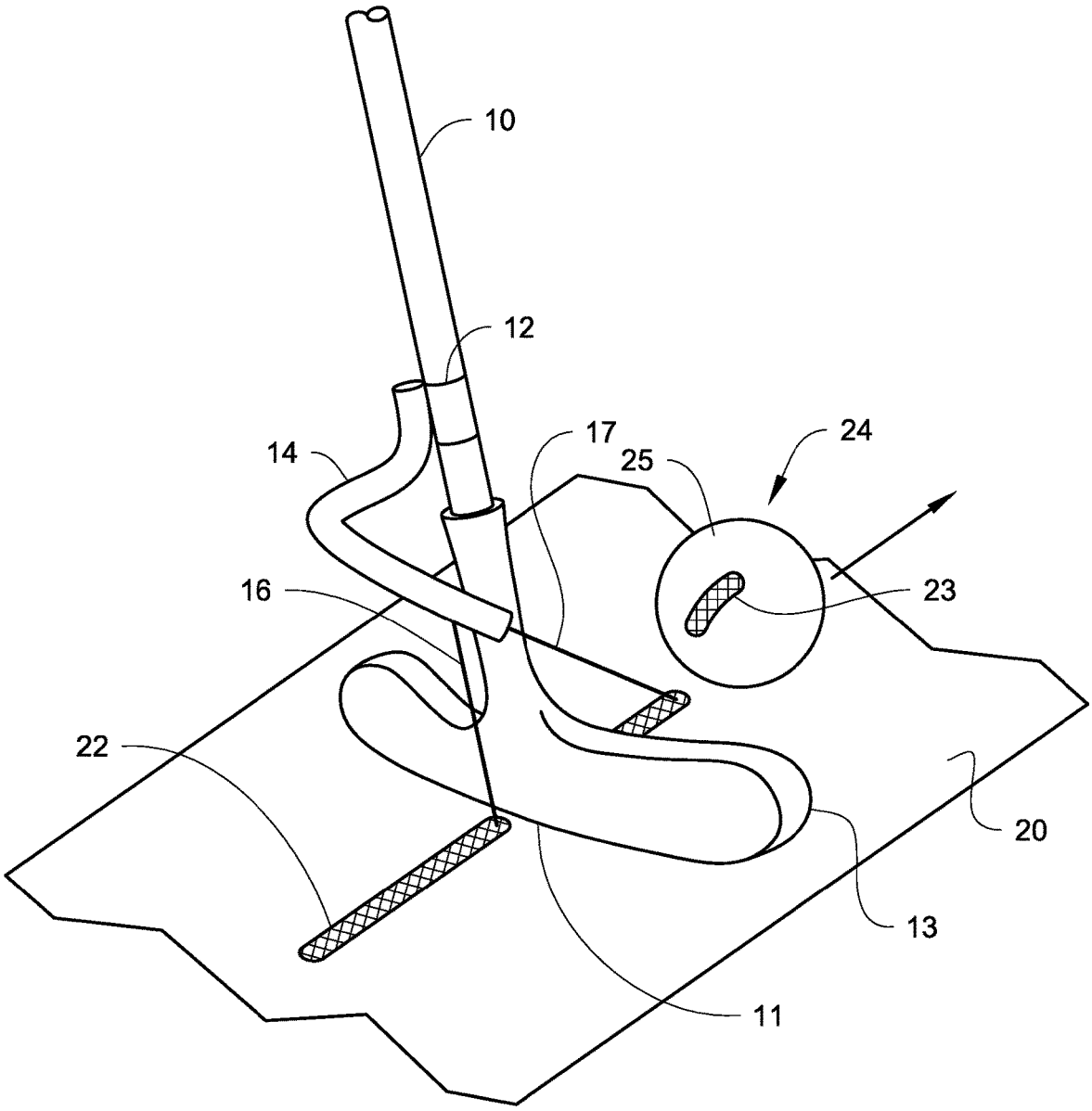
FIG. 3. Perspective view of the system and training ball, including a golf club (10) with light source (14) attached to the golf club with a fastener (12) and a training ball (24) having a surface (25) coated with a phosphorescent substrate. The light source (14) emits light (17), which generates a first phosphorescent signal (23) on the surface (25) of the training ball (24). In the illustrated embodiment, light source (14) produces also emits light (16), which generates a second phosphorescent signal (22) on the surface of the phosphorescent substrate (20).

In some embodiments, as illustrated in FIG. 3, the golf training system can further include a training ball specifically designed for use with the golf training system. The training ball allows one to receive instant feedback on the point of contact between the club head and the training ball during the practice stroke (FIG. 3). In some cases, use of the training ball allows one to discern rotation of the ball after contact with the golf club. Feedback regarding the rotation of the ball after contact can inform the user of the quality of ball contact made during the training stroke.

Generally, the training ball includes a ball (24) that has a surface (25). The ball may be any type of ball suitable for training or practicing the game of golf. In some embodiments, the training ball is a golf ball. In other embodiments, the training ball may be a practice golf ball including, but not limited to, a foam golf ball, a bean bag golf ball, or a plastic golf ball (with or without dimples, with or without whiffle-ball-style holes). The training ball may be hollow or solid. The surface of the training ball may be smooth or textured.

At least a portion of the surface (25) of the training ball (24) includes a phosphorescent material. The phosphorescent material may be applied to, attached to, affixed to, or integrated into to the surface (25) of the training ball (24) in a manner that allows the training ball (24) to be struck or otherwise be propelled by the golf club (10) without interfering with the golf stroke. The phosphorescent material emits a phosphorescent signal (23) from the surface (25) of the training ball (24) after having been exposed to light of an appropriate wavelength. The phosphorescent material may be any suitable phosphorescent material such as, for example, those materials suitable for use in the phosphorescent substrate (20). Thus, in one embodiment, the phosphorescent material includes $Eu^{2+}$,$Dy^{3+}$,B:$SrAl_2O_{x\ green}$. In other embodiments, however, the phosphorescent material can include $Eu^{2+}$,$Dy^{3+}$,B:$SrAl_2O_x$ orange, $Eu^{2+}$,$Dy^{3+}$,B:$SrAl_2O_x$ n red, ZnSu, or other suitable phosphorescent material that provides a phosphorescent signal of suitable brightness and/or suitable duration. For example, $Ba^{2+}/Mg^{2+}$ aluminate doped with Eu or Dy may, in certain embodiments, be a suitable phosphorescent material. The phosphorescent material used on the training ball (24) may be selected independently of the phosphorescent material used in the phosphorescent substrate (20). Thus, the phosphorescent material used in the surface (25) of the training ball (24) may be the same as or different than the phosphorescent material used in the phosphorescent substrate (20).

As described in detail above, the light source can be selected to produce a phosphorescent signal (23) of a desired length and a desired brightness. The phosphorescent signal (23) decays—or dims—over the course of seconds so that the training ball (24) is in condition to display a visible record of a subsequent training stroke. In some embodiments, the phosphorescent signal (23) may dim rapidly enough that the training ball (24) is essentially "clean" for a subsequent training stroke. In some embodiments, the phosphorescent signal (23) may be persistent enough that one call visibly discern rotation of the training ball (24) after contact with the golf club (10).

In some embodiments, the phosphorescent signal (23) may have a minimum duration of at least one second such as, for example, at least two seconds, at least three seconds, at least four seconds, at least five seconds, at least six seconds, at least seven seconds, at least eight seconds, at least nine seconds, or at least ten seconds. In some embodiments, the phosphorescent signal (23) may have a maximum duration of no more than 60 seconds such as, for example, no more than 30 seconds, no more than 20 seconds, no more than 19 seconds, no more than 18 seconds, no more than 17 seconds, no more than 16 seconds, no more than 15 seconds, no more than 14 seconds, no more than 13 seconds, no more than 12 seconds, no more than 11 seconds, no more than ten seconds, no more than nine seconds, no more than eight seconds, no more than seven seconds, no more than six seconds, or no more than five seconds. In some embodiments, the duration of the phosphorescent signal may be expressed as a range having endpoints defined by any minimum duration listed above and any maximum duration listed above that is greater than the selected minimum duration.

Thus, in some embodiments, the phosphorescent signal (23) may have a duration of from one second to 20 seconds such as, for example, from two seconds to 15 seconds, from three seconds to 15 seconds, from two seconds to ten seconds, from two seconds to five seconds, or from three seconds to ten seconds.

In certain embodiments, the phosphorescent signal may have a duration equal to any minimum duration or any maximum duration listed above. Thus, for example, the phosphorescent signal may have a duration of one second, two seconds, five seconds, ten seconds, 12 seconds, 20 seconds, or 60 seconds.

In some embodiments, the phosphorescent signal (23) is visible by the naked eye under ambient indoor lighting conditions (e.g., indoor lighting such as may be found in a home, office, hotel room, or indoor practice facility) without any accompanying components (e.g., a detector, a monitor, etc.).

As described in detail above and in the illustrative embodiment shown in FIG. 3, a light source (14) attached to a golf club (10) provides the light that excites the phosphorescent material and generates a phosphorescent signal (23) that transiently records the location where the club head (13) contacts the training ball (24).

In some cases, the light source (14) produces a single light (17) oriented so that during a practice stroke, the light produces a phosphorescent signal (22) on the phosphorescent substrate (20) during the practice stroke and also produces a phosphorescent signal (23) on the surface (25) of the training ball (24), as shown in FIG. 3. In such embodiments, the light source (14) can include a moldable, flexible, or bendable portion that allows the use to orient the light (17) as desired.

For example, one may wish to monitor the point of contact between the club head (13) and the training ball (24). In such embodiments, one may position the light source (14) to aim along the face of the club head (13) that contact the training ball (24) during the stroke. Prior to the club head (13) contacting the training ball (24), the light (17) will generate a phosphorescent signal (22) on the phosphorescent substrate (20), recording the path of the training stroke. At the moment of contact between the club head (13) and the training ball (24), the training ball will interrupt the path of the light (17) to the phosphorescent substrate (20) and the light (17) will instead generate a phosphorescent signal (23) on the surface of the training ball (24). As an alternative example (such as is shown in FIG. 3), the light source (14) may be oriented so that the light (17) projects ahead of the club head (13). Here again, prior to contact with the training ball (24) the light (17) will generate a phosphorescent signal (22) on the phosphorescent substrate (20), recording the path of the training stroke. In this configuration, however, the light (17) will reach the training ball (24) somewhat prior to contact between the club head (13) and the training ball (24) so that the phosphorescent signal generated on the surface (25) of the training ball (24) is linear.

In other cases, the system can involve the use of two lights, which may be generated by one light source or multiple light sources. In such embodiments, a first light may generally correspond to light (17) in FIG. 3 by projecting ahead of the club head (13), while the second light source may generally correspond to the light (16) shown in FIG. 2, oriented to project behind the club head (13).

In the preceding description and following claims, the term "and/or" means one or all of the listed elements or a combination of any two or more of the listed elements; the terms "comprises," "comprising," and variations thereof are to be construed as open ended—i.e., additional elements or steps are optional and may or may not be present; unless otherwise specified, "a," "an," "the," and "at least one" are used interchangeably and mean one or more than one; and the recitations of numerical ranges by endpoints include all numbers subsumed within that range (e.g., 1 to 5 includes 1, 1.5, 2, 2.75, 3, 3.80, 4, 5, etc.).

In the preceding description, particular embodiments may be described in isolation for clarity. Unless otherwise expressly specified that the features of a particular embodiment are incompatible with the features of another embodiment, certain embodiments can include a combination of compatible features described herein in connection with one or more embodiments.

For any method disclosed herein that includes discrete steps, the steps may be conducted in any feasible order. And, as appropriate, any combination of two or more steps may be conducted simultaneously.

The foregoing detailed description has been given for clarity of understanding only. No unnecessary limitations are to be understood therefrom. The invention is not limited to the exact details shown and described, for variations obvious to one skilled in the art will be included within the invention defined by the claims.

Unless otherwise indicated, all numbers expressing quantities of components, molecular weights, and so forth used in the specification and claims are to be understood as being modified in all instances by the term "about." Accordingly, unless otherwise indicated to the contrary, the numerical parameters set forth in the specification and claims are approximations that may vary depending upon the desired properties sought to be obtained by the present invention. At the very least, and not as an attempt to limit the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. All numerical values, however, inherently contain a range necessarily resulting from the standard deviation found in their respective testing measurements.

All headings are for the convenience of the reader and should not be used to limit the meaning of the text that follows the heading, unless so specified.

What is claimed is:

1. A training ball comprising:

a ball having a surface; and a phosphorescent material comprising $SrAl_2O_{x\,green}$:$Eu^{2+}$, $Dy^{3+}$, B, or any combination thereof, affixed to or integrated into the surface of the ball, the phosphorescent material selected to produce a phosphorescent signal when exposed to light from a light source, the phosphorescent signal having a duration of from one second to 60 seconds.

2. A golf training system comprising:

a light source attached to a golf club;

the training ball of claim 1; and a phosphorescent substrate positioned beneath the light source and golf club, the phosphorescent substrate selected to produce a phosphorescent signal when exposed to light from the light source, the phosphorescent signal having a duration of from one second to 60 seconds.

3. The golf training system of claim 2, wherein the light source emits light having a wavelength of from 200 nm to 410 nm.

4. The golf training system of claim 2, wherein:

the light source comprises a distal end;

the golf club comprises a club head having a sole; and the distal end of the light source is 1 cm to 150 cm from the sole of the golf club.

5. A method of recording a swing path, the method comprising:

providing the golf training system of claim 2; and performing a training stroke having a swing path so that light emitted from the light source excites the phosphorescent substrate, thereby producing a transient phosphorescent signal that records the swing path.

6. The method of claim 5, wherein the transient phosphorescent signal has a duration of from one second to 60 seconds.

7. The method of claim 5, wherein the transient phosphorescent signal is visible with no additional components.

8. The training ball of claim 1, wherein the phosphorescent signal is visible with no additional components.

9. A method of recording a point of contact between a golf club and a training ball, the method comprising:

providing a golf training system comprising:

a golf club comprising a club head; and a light source attached to golf club;

providing the training ball of claim 1; and performing a training stroke such that the club head contacts at least a portion of the surface of the training ball so that light emitted from the light source excites the phosphorescent material on the training ball and produces the transient phosphorescent signal at the point of contact between the club head and the training ball.

10. The method of claim 9, wherein the phosphorescent signal is visible with no additional components.

11. The training ball of claim 1, wherein the phosphorescent material is affixed to or integrated into a portion of the surface of the ball.

12. A method of simultaneously recording a training golf swing path and a point of contact between a golf club and a training ball, the method comprising:

providing a golf training system comprising:

a golf club comprising a club head;

a light source attached the golf club; and a phosphorescent substrate positioned beneath the light source and golf club, the phosphorescent substrate selected to produce a first phosphorescent signal when exposed to light from the light source;

providing the training ball of claim 1; and performing a training stroke having a swing path wherein the club head contacts at least a portion of the surface of the training ball so that light emitted from the light source excites both the phosphorescent substrate and the phosphorescent material of the training ball, thereby producing the first phosphorescent signal that records the swing path and the second phosphorescent signal at the point of contact between a golf club and a training ball.

13. The method of claim 12, wherein the first phosphorescent signal has a duration of from one second to 60 seconds.

14. The method of claim 12, wherein the second phosphorescent signal has a duration of from one second to 60 seconds.

15. The method of claim 12, wherein the first phosphorescent signal and the second phosphorescent signal are visible with no additional components.

* * * * *